US009217958B1

(12) United States Patent
Washino

(10) Patent No.: US 9,217,958 B1
(45) Date of Patent: Dec. 22, 2015

(54) IMAGE FORMING APPARATUS

(71) Applicant: FUJI XEROX CO., LTD., Tokyo (JP)

(72) Inventor: Shigeki Washino, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/721,403

(22) Filed: May 26, 2015

(30) Foreign Application Priority Data

Oct. 21, 2014 (JP) ..... 2014-214648

(51) Int. Cl.
*G03G 15/16* (2006.01)
*G03G 15/01* (2006.01)

(52) U.S. Cl.
CPC ..... *G03G 15/1605* (2013.01); *G03G 15/0131* (2013.01)

(58) Field of Classification Search
None
See application file for complete search history.

(56) References Cited

U.S. PATENT DOCUMENTS

2008/0298853 A1* 12/2008 Yamada ..... G03G 15/0818 399/279

FOREIGN PATENT DOCUMENTS

| | | | |
|---|---|---|---|
| JP | 2003-280323 | A | 10/2003 |
| JP | 2009-128775 | A | 6/2009 |
| JP | 4525506 | B2 | 8/2010 |

* cited by examiner

*Primary Examiner* — Clayton E Laballe
*Assistant Examiner* — Jas Sanghera
(74) *Attorney, Agent, or Firm* — Oliff PLC

(57) ABSTRACT

An image forming apparatus includes a first transfer unit that transfers a first image formed by first liquid containing a toner to a medium, a first supplier that has a first concave-convex pattern, has a first rotation axis, and rotates to supply the first liquid containing the toner to the first transfer unit, a second transfer unit that transfers a second image formed by second liquid containing a toner of which a color is the same as a color of the toner used in the first liquid to superimpose the second image on the first image transferred to the medium, and a second supplier that has a second concave-convex pattern, has a second rotation axis, and rotates to supply the second liquid containing the toner to the second transfer unit.

16 Claims, 14 Drawing Sheets

IMAGE FORMING APPARATUS

CROSS-REFERENCE TO RELATED APPLICATIONS

This application is based on and claims priority under 35 USC 119 from Japanese Patent Application No. 2014-214648 filed Oct. 21, 2014.

BACKGROUND

Technical Field

The present invention relates to an image forming apparatus.

SUMMARY

According to an aspect of the invention, there is provided an image forming apparatus including:

a first transfer unit that transfers a first image formed by first liquid containing a toner to a medium;

a first supplier that has a first concave-convex pattern formed on an outer peripheral surface thereof, has a first rotation axis, and rotates to supply the first liquid containing the toner to the first transfer unit;

a second transfer unit that transfers a second image formed by second liquid containing a toner of which a color is the same as a color of the toner used in the first liquid to superimpose the second image on the first image transferred to the medium; and a second supplier that has a second concave-convex pattern formed on an outer peripheral surface thereof and having a shape different from a shape of the first concave-convex pattern, has a second rotation axis, and rotates to supply the second liquid containing the toner to the second transfer unit.

BRIEF DESCRIPTION OF THE DRAWINGS

Exemplary embodiments of the present invention will be described in detail based on the following figures, wherein:

FIG. 3A is a view showing the transparent medium from the back side, and FIG. 3B is a cross-sectional view taken along line B-B;

FIG. 4A is a view showing the transparent medium from the back side, and FIG. 4B is a cross-sectional view taken along line B-B;

FIGS. 6A and 6B are views showing a concave-convex pattern formed on a portion surrounded by a two-dot chain line of FIG. 5, FIG. 6A is a view showing a concave-convex pattern of a W (white)-supply roll that is provided on an upstream side in a medium transport direction, and FIG. 6B is a view showing a concave-convex pattern of a W (white)-supply roll that is provided on a downstream side in the medium transport direction;

FIG. 7 is a view showing a concave-convex pattern that is formed on the portion surrounded by the two-dot chain line of FIG. 5;

FIG. 9A is a view showing a concave-convex pattern of a W (white)-supply roll that is provided on an upstream side in a medium transport direction, and FIG. 9B is a view showing a concave-convex pattern of a W (white)-supply roll that is provided on a downstream side in the medium transport direction;

FIG. 11A is a view showing the transparent medium from the front side, and FIG. 11B is a cross-sectional view taken along line B-B;

FIG. 13A is a view showing a paper medium from the front side, and FIG. 13B is a cross-sectional view taken along line B-B;

DETAILED DESCRIPTION

<<Outline>>

Figure 1:
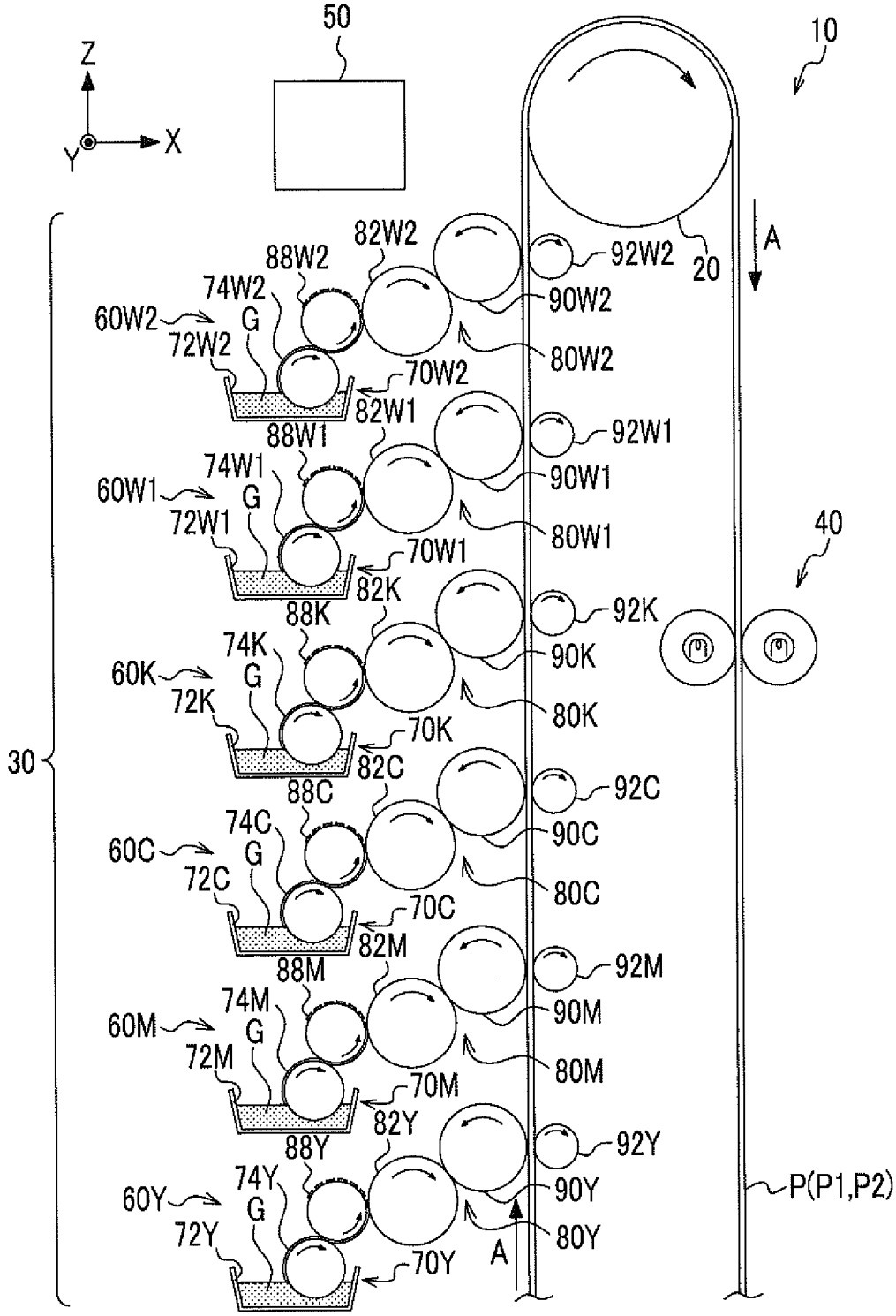
FIG. 1 is a schematic view (front view) of an image forming apparatus according to a first exemplary embodiment.

Exemplary embodiments (first to fifth exemplary embodiments) will be described below with reference to the drawings. In the following description, a direction indicated in the drawings by an arrow Z is referred to as a height direction of an apparatus and a direction indicated in the drawings by an arrow X is referred to as a width direction of the apparatus. Further, a direction (a direction indicated by an arrow Y), which is orthogonal to the height direction and the width direction of the apparatus, is referred to as a depth direction of the apparatus.

First Exemplary Embodiment

First, the image forming apparatus according to this exemplary embodiment and a developer will be described. Then, a concave-convex pattern of a supply roll of a W (white)-supply unit, which is a main part of this exemplary embodiment, will be described. After that, the operation of this exemplary embodiment will be described.

<Entire Structure of Image Forming Apparatus>

An image forming apparatus 10 has a function of forming an image on a medium P by forming toner images using developers G that contain toners and non-volatile oil, transferring the toner images to the medium P to be transported, and fixing the toner images to the medium P. Here, the developer G is an example of liquid containing a toner. As shown in FIG. 1, the image forming apparatus 10 includes a transport device 20, an image forming section 30, a fixing device 40, and a control section 50.

[Transport Device]

The transport device 20 has a function of transporting the medium P in a direction of an arrow A (transport direction). Meanwhile, the medium P transported by the transport device 20 is a continuous medium.

[Image Forming Section]

The image forming section 30 has a function of forming a multi-color toner image by superimposing color toner images, which are formed by image forming units 60Y, 60M, 60C, 60K, 60W1, and 60W2 to be described below, on the medium P to be transported. The image forming section 30 is disposed on the upstream side of the transport device 20 in the transport direction of the medium P.

(Image Forming Unit)

Each of the image forming units 60Y, 60M, 60C, 60K, 60W1, and 60W2 has a function of forming each color toner image as described above and transfer the color toner image to the medium P to be transported. As shown in FIG. 1, the image forming units 60Y, 60M, 60C, 60K, 60W1, and 60W2 are disposed along a transport path of the medium P toward the downstream side from the upstream side in the transport direction of the medium P in this order.

Here, suffix "Y" means yellow, suffix "M" means magenta, suffix "C" means cyan, and suffix "K" means black, and the image forming units 60Y, 60M, 60C, and 60K are used to form yellow, magenta, cyan, and black toner images, respectively. Further, suffix "W" means white, and the image forming units 60W1 and 60W2 are used to form white toner images. Meanwhile, numerals of "roll" and "W2" do not mean a difference in color, but mean an order in which the image forming units 60W1 and 60W2 are disposed along the transport path of the medium P from the upstream side in the transport direction of the medium P. Furthermore, reference characters Y, M, C, K, and W mean yellow, magenta, cyan, black, and white toner images in FIGS. 3A and 3B, 4A and 4B, 11A and 11B, and 13A and 13B.

Moreover, the image forming units 60Y, 60M, 60C, 60K, and 60W1 have the same structure except for the colors of the toners that are contained in the developers G to be used. In contrast, the image forming units 60W1 and 60W2 have the same structure except for concave-convex patterns 100 and 200 that are formed on the outer peripheral surfaces of the supply rolls to be described below (see FIGS. 6A and 6B). Hereinafter, when the colors (K, C, M, Y, and W) of the toners do not need to be particularly distinguished from each other, suffixes K, C, M, Y, W1, and W2 will be omitted in the description of the image forming units 60Y, 60M, 60C, 60K, 60W1, and 60W2 and components thereof.

Figure 2:
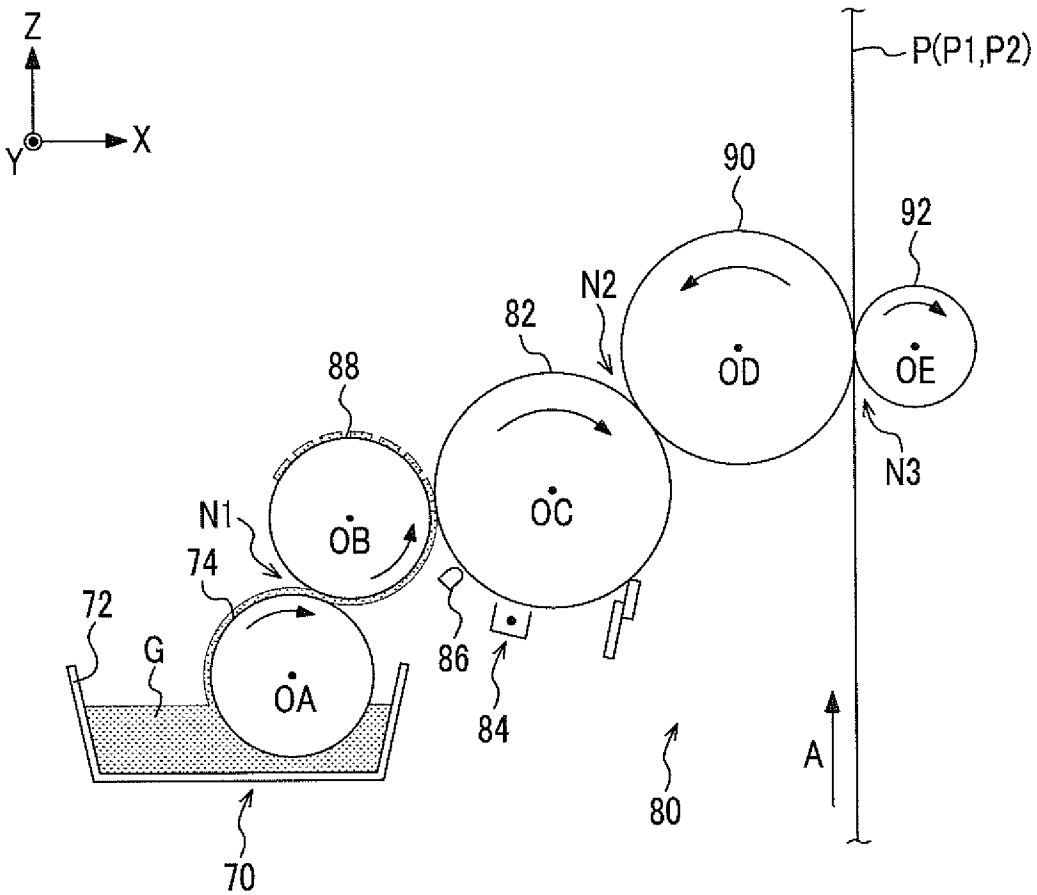
FIG. 2 is a schematic view (front view) of an image forming unit of the image forming apparatus according to the first exemplary embodiment.

As shown in FIGS. 1 and 2, the image forming unit 60 includes a supply unit 70 and a transfer unit 80. Meanwhile, suffixes K, C, M, Y, W1, and W2 are omitted in FIG. 2.

<Supply Unit>

The supply unit 70 has a function of storing the developer G and supply the developer G to the transfer unit 80. As shown in FIGS. 1 and 2, the supply unit 70 includes a vessel 72 and a supply roll 74. Here, a supply roll 74W1 of the image forming unit 60W1 is an example of a first supplier. Further, a supply roll 74W2 of the image forming unit 60W2 is an example of a second supplier. Meanwhile, a part of the supply roll 74 is immersed in the developer G stored in the vessel 72 as shown in FIGS. 1 and 2.

The vessel 72 has a function of storing the developer G. Since the vessel 72 is connected to an external tank (not shown), the developer G stored in the external tank is supplied to the vessel 72.

The supply roll 74 has a function of scooping up the developer G stored in the vessel 72 and to supply the developer G to a developing roll 88 to be described below at a nip N1 between itself and the developing roll 88 while rotating about an axis thereof (about an axis OA). Here, the thickness of the developer G is adjusted by a blade (not shown), the developer G is charged by a charging unit (not shown) so as to have, for example, a positive polarity, and a voltage is applied to the developer G by a power source (not shown), so that an electric field is formed at the nip N1. Accordingly, the developer G is supplied to the developing roll 88.

Figure 5:
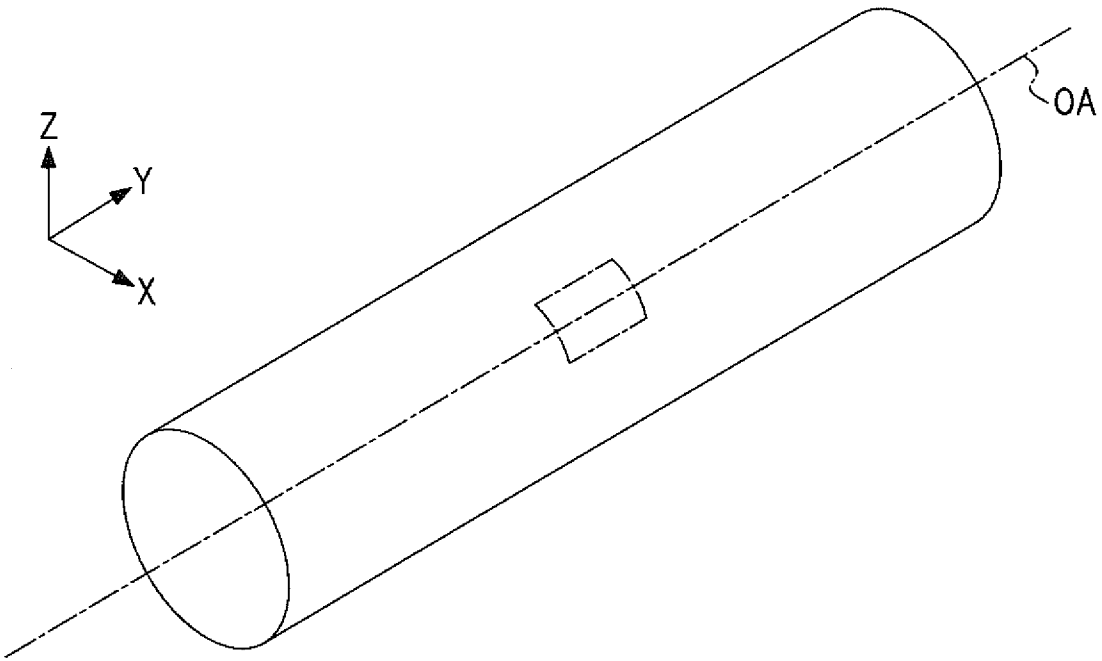
FIG. 5 is a perspective view of a supply roll of the image forming unit.

The supply roll 74 is formed in a columnar shape (see FIG. 5). Further, a concave-convex pattern 100 is formed on the outer peripheral surface of each of the supply rolls 74Y, 74M, 74C, 74K, and 74W1 (see FIG. 6A). Furthermore, a concave-convex pattern 200 is formed on the outer peripheral surface of the supply roll 74W2 (see FIG. 6B). While rotating about an axis thereof, the supply rolls 74 put the developer G, which is stored in the vessels 72, in recesses 110 and 210 of the concave-convex patterns 100 and 200 and scoop up the developers G. Here, the concave-convex pattern 100 is an example of a first concave-convex pattern. Moreover, the concave-convex pattern 200 is an example of a second concave-convex pattern.

Meanwhile, a relationship between the concave-convex pattern 100 of the supply roll 74W1 and the concave-convex pattern 200 of the supply roll 74W2 will be described below.

<Transfer Unit>

The transfer unit 80 has a function of transferring the toner image, which is developed on a photoreceptor 82 to be described below by using the developer G, to the medium P that is transported by the transport device 20. Here, any one of the transfer units 80Y, 80M, 80C, and 80K of the image forming units 60Y, 60M, 60C, and 60K or the combination of two or more of the transfer units 80Y, 80M, 80C, and 80K is an example of a third transfer unit. Toner images, which are transferred to the medium P by one or more of the transfer units 80Y, 80M, 80C, and 80K, are an example of a third image. The transfer unit 80W1 of the image forming unit 60W1 is an example of a first transfer unit. A toner image, which is transferred to the medium P by the transfer unit 80W1, is an example of a first image. The transfer unit 80W2 of the image forming unit 60W2 is an example of a second transfer unit. A toner image, which is transferred to the medium P by the transfer unit 80W2, is an example of a second image.

As shown in FIG. 2, the transfer unit 80 includes the photoreceptor 82, a charging unit 84, an exposure unit 86, the developing roll 88, a transfer drum 90, and a transfer roll 92.

(Photoreceptor)

The photoreceptor 82 has a function of holding a latent image. The photoreceptor 82 is formed of a cylindrical member, and is rotatable about an axis thereof (about an axis OC).

(Charging Unit)

The charging unit 84 has a function of charging the photoreceptor 82. The charging unit 84 is disposed along the axis of the photoreceptor 82.

(Exposure Unit)

The exposure unit 86 has a function of forming a latent image on the photoreceptor 82 that is charged by the charging unit 84.

(Developing Roll)

The developing roll 88 has a function of developing the latent image, which is held by the photoreceptor 82, as a toner image by using the developer G that is supplied from the supply unit 70. The developing roll 88, which is formed of a column, and the photoreceptor 82 and the supply roll 74 are rotatably disposed so as to be aligned with each other in the axial direction.

(Transfer Drum)

The transfer drum 90 has a function of allowing the toner image, which is formed on the photoreceptor 82, to be primarily transferred to the outer peripheral surface of the transfer drum 90 and holding the toner image. The transfer drum 90 is formed of a cylindrical member. The transfer drum 90 forms a nip N2 together with the photoreceptor 82 and a voltage is applied to the transfer drum 90 by a power source (not shown), so that an electric field is formed at the nip N2. Accordingly, the transfer drum 90 is held the toner image, which is primarily transferred thereto, while rotating about an axis thereof (about an axis OD).

(Transfer Roll)

The transfer roll 92 has a function of secondarily transferring the toner image, which is held on the outer peripheral surface of the transfer drum 90, to the medium P to be transported. The transfer roll 92 is formed of a column. The transfer roll 92 is disposed on one side of the transport path of the medium P opposite to the transfer drum 90 in the depth direction of the apparatus, and forms a nip N3 together with the transfer drum 90. A voltage is applied to the transfer roll 92 by a power source (not shown), so that an electric field is formed at the nip N3. Accordingly, the transfer drum 90 is conducted to secondarily transfer the toner image, which is held on the outer peripheral surface of the transfer drum 90, to the medium P while rotating about an axis thereof (about an axis OE).

[Fixing Device]

The fixing device 40 has a function of fixing the multi-color toner image, which is formed on the medium P by the image forming section 30, to the medium P by heating and pressurizing the multi-color toner image. The fixing device 40 is disposed on the downstream side of the transport device 20 in the transport direction of the medium P.

[Control Section]

The control section 50 has a function of controlling the respective components (the transport device 20, the image forming section 30, the fixing device 40, and the like) of the image forming apparatus 10.

[Developer]

The developer G, which is used in the image forming apparatus 10 according to this exemplary embodiment, is a liquid developer that is obtained by dispersing a powder toner in oil. In this exemplary embodiment, each color toner is, for example, powder having a volume average particle size of 5 μm. Further, the oil is, for example, dimethyl silicone oil (one kind of silicone oil). Here, the dimethyl silicone oil is non-volatile oil. Meanwhile, "non-volatile" means that the oil has a flash point of 130° C. or greater, or the oil has not more than 8% by weight of a volatile component at 150° C. after 24 hours.

[Supplement]

(Medium Used in Image Forming Apparatus)

In the image forming apparatus 10 according to this exemplary embodiment, an image may be formed on, for example, a transparent medium P2 other than a paper medium P1. Here, the paper medium P1 and the transparent medium P2 are examples of the medium. Further, the transparent medium P2 is an example of a transparent medium. Meanwhile, when an image is to be formed on the transparent medium P2, the transparent medium 92 is mounted on the transport device 20 by a worker. (Rotational speed (circumferential speed) of each component of image forming unit 60)

As described above, each of the components (the supply roll 74, the photoreceptor 82, the developing roll 88, the transfer drum 90, and the transfer roll 92) of the image forming unit 60 corresponding to each color is rotatable about the axis thereof. Here, each component of the image forming unit 60 corresponding to each color is rotatable about the axis thereof at a predetermined circumferential speed. Further, the circumferential speeds of the respective components are equal to each other. That is, the circumferential speed of the supply roll 74W1 and the circumferential speed of the supply roll 74W2 are equal to each other.

(Toner Images Transferred to Medium from Transfer Unit 80W1 and Transfer Unit 80W2)

As described above, the transfer unit 80W1 transfers a white toner image to the medium P to be transported, and the transfer unit 80W2 transfers a white toner image to the medium P to be transported. In this case, the transfer unit 80W2 transfers the white toner image so that the white toner images are superimposed on the toner image transferred to the medium P by the transfer unit 80W1. Further, the transfer units 80W1 and 80W2 transfer the superimposed white toner images, which serve as an undercoat, to the toner images that are transferred to the transparent medium P2 by the transfer units SOY, 80M, 80C, and 80K. Furthermore, the transfer units 80W1 and 80W2 transfer the superimposed white toner images, which serve as a background image, to a portion of the transparent medium P2 except for the portion to which the toner images are transferred by the transfer units 80Y, 80M, 80C, and 80K. That is, the "undercoat" means the superimposed white toner images that are formed under the toner images (third image) transferred to the transparent medium P2 by the transfer units 80Y, 80M, 80C, and 80K. Moreover, the "background image" means the superimposed white toner images that are formed on a portion of an image forming region of the transparent medium P2 except for the portion on which the third image is formed. Meanwhile, when the third image is formed on the entire image forming region of the transparent medium P2, the background image is not formed.

The thickness of each of the white toner images, which are transferred to the medium P from the transfer units 80W1 and 80W2, is substantially the same thickness as the volume average particle size of a white toner particle, that is, about 5 μm. From another perspective, since the developer G used in the image forming apparatus 10 according to this exemplary embodiment is a liquid developer as described above, the thickness of each white toner image cannot but be substantially the same thickness as the volume average particle size of the white toner particle. For this reason, the thickness of the superimposed white toner images is about 10 μm.

<Image Forming Process>

Next, an image forming process performed by the image forming apparatus 10 will be described with reference to FIGS. 1, 2, 3A, and 3B. Meanwhile, an image forming operation performed by the image forming apparatus 10 is achieved through the control of each component of the image forming apparatus 10 that is performed by the control section 50.

A computer (not shown) transmits image data to the control section 50. Here, image data are, for example, data that are formed on the transparent medium P2 and are formed of data that include a black character A, multi-color characters B and C having yellow, magenta, and cyan colors, a white undercoat, and a white background image. Meanwhile, a transparent medium P2 is mounted on the transport device 20 by a worker.

Next, when receiving image data from the computer (not shown), the control section 50 converts the image data into exposure data corresponding to the respective colors except for a white color and sends the exposure data corresponding to yellow, magenta, cyan, and black colors to the exposure units 86Y, 86M, 86C, and 86K. Also the control section 50 sends exposure data, which are used to form solid images in the entire image forming regions of the photoreceptors 82W1 and 82W2, to the exposure units 86W1 and 86W2 (not shown).

After that, in the image forming unit 60Y, the photoreceptor 82Y rotates and the photoreceptor 82Y is charged by the charging unit 84Y. Then, the charged photoreceptor 82Y is exposed by the exposure unit 86Y, so that a yellow latent image is formed on the photoreceptor 82Y. Further, the yellow latent image is developed as a yellow toner image by the developing roll 88Y to which a yellow developer G is supplied from the supply unit 70Y.

Next, the yellow toner image reaches the nip N2 by the rotation of the photoreceptor 82Y, and is primarily transferred to the transfer drum 90Y. Furthermore, the yellow toner image transferred to the transfer drum 90Y reaches the nip N3 by the rotation of the transfer drum 90Y. Moreover, the yellow toner image having reached the nip N3 is secondarily transferred to the transparent medium P2, which is to be transported, by the transfer roll 92Y.

Likewise, in the image forming units 60M and 60C, magenta and cyan toner images are sequentially secondarily transferred to the transparent medium P2 from transfer drums 90M and 90C so as to be superimposed on the yellow toner image that is secondarily transferred to the transparent medium P2. Further, in the image forming unit 60K, a black toner image (character A) is sequentially secondarily transferred to the transparent medium P2 from the transfer drum 90K.

After that, in the image forming unit 60W1, the white toner image developed on the entire image forming region of the photoreceptor 82W1 is secondarily transferred to the transparent medium P2 to which the toner images of the characters A, B, and C are secondarily transferred from the transfer drum 90W1.

Next, in the image forming unit 60W2, the white toner image developed on the entire image forming region of the photoreceptor 82W2 is secondarily transferred to the white toner image that is secondarily transferred to the transparent medium P2 by the image forming unit 60W1.

After that, the transparent medium P2 on which the toner image is formed by the image forming section 30 is transported by the transport device 20 and reaches the fixing device 40. Then, the toner image formed on the transparent medium P2 is fixed to the transparent medium P2 by being heated and pressurized by the fixing device 40.

Figure 3B:
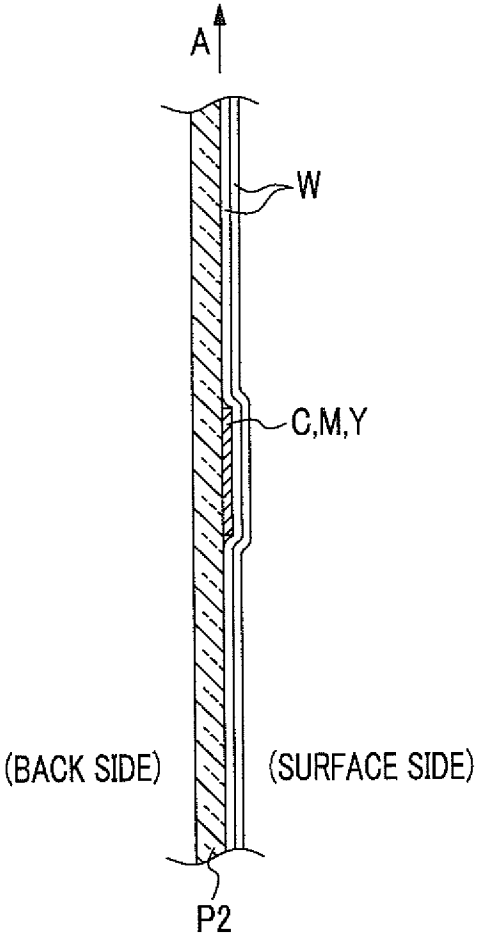
FIGS. 3A and 3B are views showing an image that is formed on a transparent medium by the image forming apparatus according to the first exemplary embodiment.
Figure 3A:
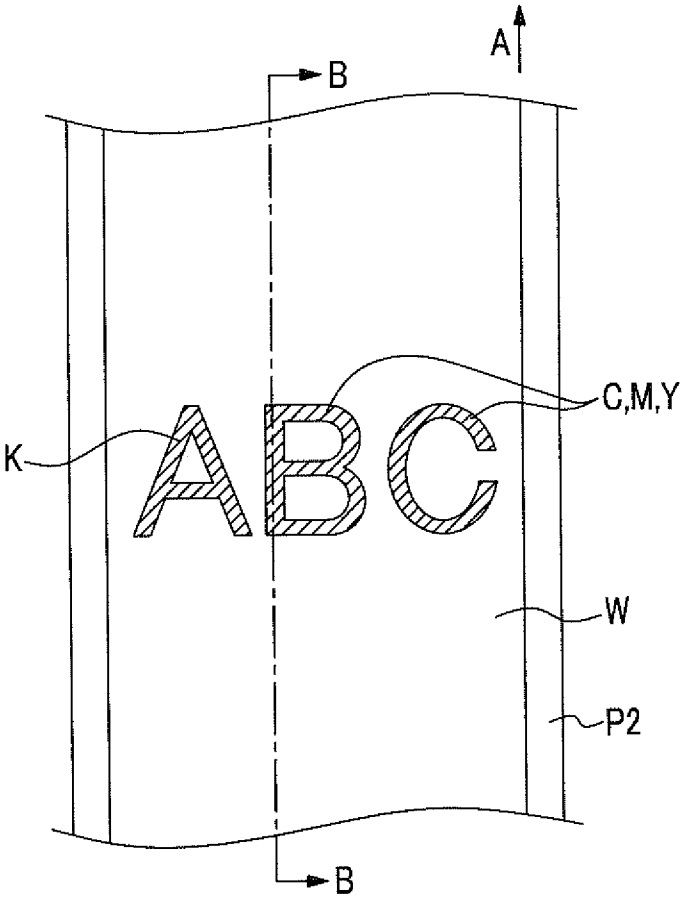

The transparent medium P2 to which the toner image is fixed by the fixing device 40 is transported by the transport device 20 and is wound by a winding device (not shown). After that, the transparent medium P2 wound by the winding device is cut by a cutting device (not shown), so that a printed matter is completed. Meanwhile, FIGS. 3A and 3B show images that are formed on the transparent medium P2 using the image data. Here, the printed matter, which is completed by the image forming process of this exemplary embodiment, is visually recognized from the back side of the transparent medium P2 (the surface of the transparent medium opposite to the surface on which the toner image is formed).

Figure 4B:
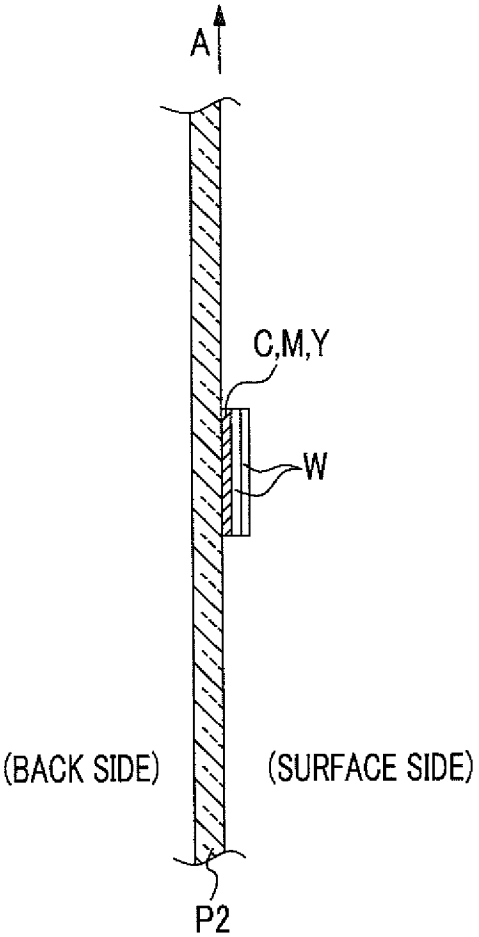
FIGS. 4A and 4B are views showing an image that is formed on a transparent medium by the image forming apparatus according to the first exemplary embodiment.
Figure 4A:
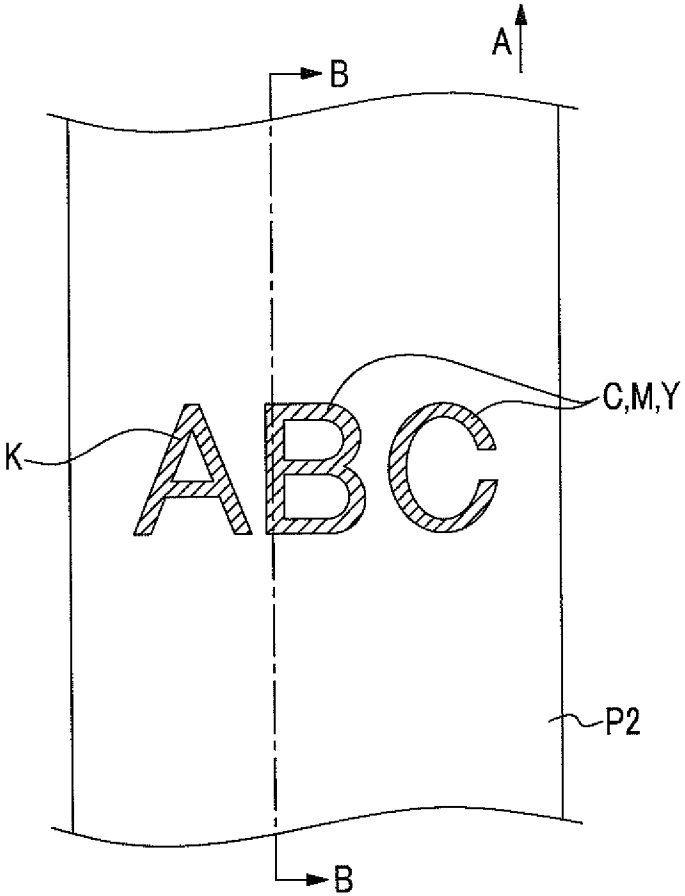

The image forming process of forming an image on the transparent medium P2 by the image forming apparatus 10 has been described above. Meanwhile, in the image forming apparatus 10, an image may also be formed on the transparent medium P2 as shown in FIGS. 4A and 4B. In this case, image data of a white undercoat are converted into exposure data of characters A, B, and C and are sent to the exposure units 86W1 and 86W2, so that the same image forming process as the above-mentioned image forming process is performed. Further, when forming a toner image by using the paper medium P1, the image forming apparatus 10 may also form an image without using the image forming units 60W1 and 60W2, unlike in the above-mentioned image forming process.

<Main Part (Concave-Convex Pattern of Supply Roll of White-Supply Unit)>

Next, main parts of this exemplary embodiment will be described with reference to the drawings.

[Concave-Convex Pattern of Supply Roll 74W1]

Figure 6A:
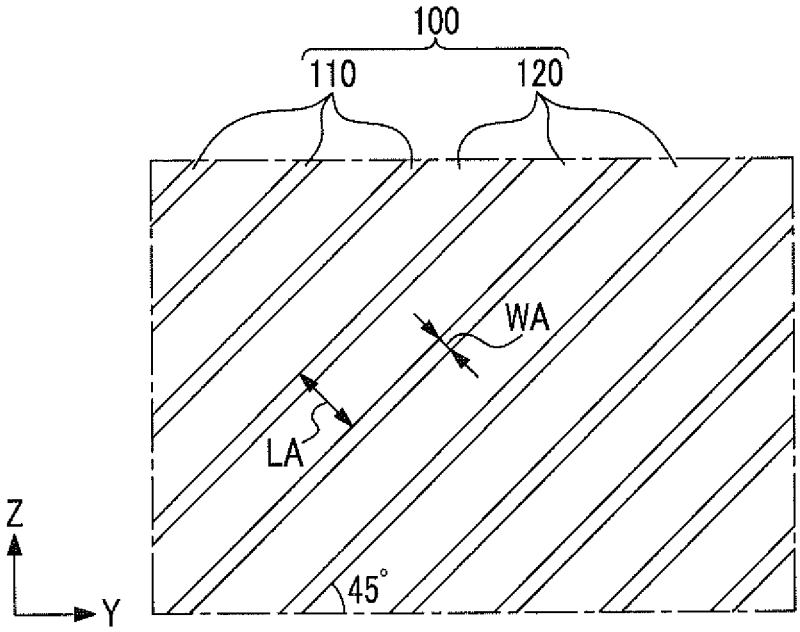
FIGS. 6A and 6B are views showing a concave-convex pattern of a W (white)-supply roll of the first exemplary embodiment. Further.

As shown in FIG. 6A, the supply roll 74W1 is an anilox roll of which the outer peripheral surface includes a concave-convex pattern 100 formed by recesses 110 and protrusions 120. Furthermore, the recesses 110 are formed so as to have a predetermined depth, a predetermined width WA, and a predetermined interval LA. Moreover, when seen in the radial direction of the supply roll 74W1, the recesses 110 and the protrusions 120 are inclined with respect to the axis of the supply roll 74W1 by an angle of 45° (an example of a predetermined angle). That is, the concave-convex pattern 100 is formed of plural spiral patterns (hereinafter, referred to as a first spiral pattern 100) that are formed on the outer peripheral surface of the supply roll 74W1 and are inclined by an angle of 45°. Meanwhile, the axis of the supply roll 74W1 is parallel to the depth direction of the apparatus.

[Concave-Convex Pattern of Supply Roll 74W2]

Figure 6B:
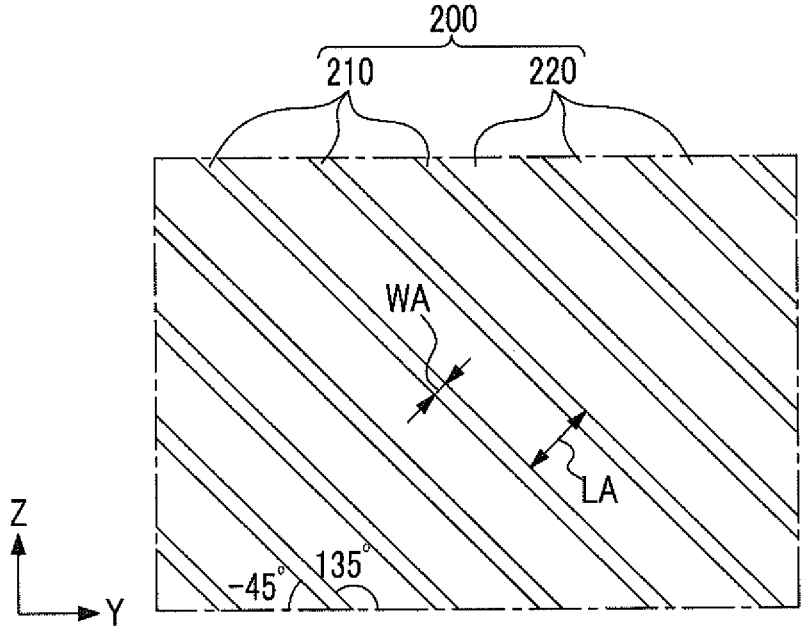

As shown in FIG. 6B, the supply roll 74W2 is an anilox roll of which the outer peripheral surface includes a concave-convex pattern 200 formed by recesses 210 and protrusions 220. Furthermore, the recesses 210 are formed so as to have the same depth as the predetermined depth of the recess 110, the predetermined width WA of the recess 110, and the predetermined interval LA of the recess 110. Moreover, when seen in the radial direction of the supply roll 74W1, the recesses 210 and the protrusions 220 are inclined with respect to the axis of the supply roll 74W2 by an angle 135° (an example of a predetermined angle). That is, the concave-convex pattern 200 is formed of plural spiral patterns (hereinafter, referred to as a second spiral pattern 200) that are formed on the outer peripheral surface of the supply roll 74W2 and are inclined by an angle of 135°. Meanwhile, the axis of the supply roll 74W2 is parallel to the depth direction of the apparatus. From another perspective, the recesses 210 and the protrusions 220 are inclined with respect to the axis of the supply roll 74W2 by an angle of −45°.

That is, the first and second spiral patterns 100 and 200 are inclined in directions opposite to each other, and the recesses 110 and 210 are formed so as to have a predetermined depth, a predetermined width WA, and a predetermined interval LA.

The structure of the concave-convex pattern 100 of the supply roll 74W1 and the structure of the concave-convex pattern 200 of the supply roll 74W2 have been described above.

<Operation>

[Outline]

Next, the operation of this exemplary embodiment will be described with reference to the drawings. Here, the operation of this exemplary embodiment will be described through the comparison of this exemplary embodiment and a first comparative embodiment to be described below. Meanwhile, when members and the like used in the image forming apparatus 10 according to this exemplary embodiment are used in the first comparative embodiment, the first comparative embodiment will be described using the reference numerals of the members and the like without change.

The supply roll 74W1 of the image forming unit 60W1 is mounted on an image forming apparatus according to the first comparative embodiment (hereinafter, referred to as a comparative apparatus), instead of the supply roll 74W2 of the image forming unit 60W2. The comparative apparatus has the same structure as the image forming apparatus 10 according to this exemplary embodiment except for the above-mentioned respect.

Here, a case in which the image shown in FIGS. 3A and 3B is formed on the transparent medium P2 by the comparative apparatus is considered. When the image is formed by the comparative apparatus, portions of the superimposed white toner images corresponding to the recesses 210 of the supply roll 74W2 of the image forming unit 60W2 may overlap portions of the superimposed white toner images, which correspond to the recesses 110 of the supply roll 74W1 of the image forming unit 60W1, in the inclination direction of the recesses 110. As a result, pale spots caused by the concave-convex pattern 100 are formed on the white toner images that are transferred to the transparent medium P2 by the comparative apparatus and are superimposed. Further, when the pale spots are formed on the white toner images, the visibility of the white background image deteriorates due to the pale spots. Furthermore, the visibility of the characters A, B, and C, which are formed on the white toner images as a undercoat, also deteriorates due to the pale spots.

Here, the toner image of which the visibility is poor means a toner image of which the contrast ratio is lower than 40%. Further, the contrast ratio of the white toner image, which is transferred to the transparent medium P2 and superimposed by the comparative apparatus, is 33%. Meanwhile, a contrast ratio is measured by a method A according to JISK5600-4-1.

In contrast, in the image forming apparatus 10 according to this exemplary embodiment, the concave-convex patterns 100 and 200 of the supply rolls 74W1 and 74W2 of the image forming units 60W1 and 60W2 are inclined with respect to the directions of the axes of the supply rolls 74W1 and 74W2 by different angles as shown in FIGS. 6A and 6B. For this reason, when a toner image shown in FIGS. 3A and 3B is transferred to the transparent medium P2, the portions of the superimposed white toner images corresponding to the recesses 210 of the supply roll 74W2 do not overlap the portions of the superimposed white toner images, which correspond to the recesses 110 of the supply roll 74W1, in the inclination direction of the recesses 210. For this reason, pale spots caused by the concave-convex pattern 200 are not easily formed on the superimposed white toner images that are transferred to the transparent medium P2 by the image forming apparatus 10 according to this exemplary embodiment. Meanwhile, the contrast ratio of the superimposed white toner images, which are formed by the image forming apparatus 10 according to this exemplary embodiment, is 51%.

Accordingly, according to the image forming apparatus 10 of this exemplary embodiment, the contrast ratio of the superimposed white images is high in comparison with the case of the comparative apparatus. As a result, according to the image forming apparatus 10 of this exemplary embodiment, it is possible to form an image in which a white undercoat having a high contrast ratio is superimposed on the characters A, B, and C.

Meanwhile, in the image forming apparatus 10 according to this exemplary embodiment, the recesses 110 and 210 of the supply rolls 74W1 and 74W2 are inclined in directions, which are opposite to each other, with respect to the directions of the axes of the supply rolls 74W1 and 74W2 by the same angle, that is, 45° and 135° (−45°) as shown in FIGS. 6A and 6B. Further, the recesses 110 and 210 are formed so as to have a predetermined depth, a predetermined width WA, and a predetermined interval LA. For this reason, when the supply rolls 74W1 and 74W2 rotate about the axes thereof at the same circumferential speed, the amount of the developers G supplied to the developing rolls 88 per unit time by the supply roll 74W1 and the amount of the developers G supplied to the developing rolls 88 per unit time by the supply roll 74W2 (hereinafter, referred to as the amounts of the developers G to be supplied) are equal to each other.

Accordingly, according to the image forming apparatus 10 of this exemplary embodiment, it is possible to make the amounts of the developers G to be supplied be the same while making the circumferential speeds of the supply rolls 74W1 and 74W2 be the same in comparison with an image forming apparatus in which the angle between the recess 110 and the direction of the axis of the supply roll is different from the angle between the recess 210 and the direction of the axis of the supply roll. For this reason, it is not necessary to adjust the circumferential speeds of the respective supply rolls 74W1 and 74W2.

Second Exemplary Embodiment

Next, an image forming apparatus 10 according to a second exemplary embodiment will be described with reference to FIGS. 7 and 8. Meanwhile, when members and the like used in the image forming apparatus 10 according to the first exemplary embodiment are used in the second exemplary embodiment, the second exemplary embodiment will be described using the reference numerals of the members and the like without change.

Figure 7:
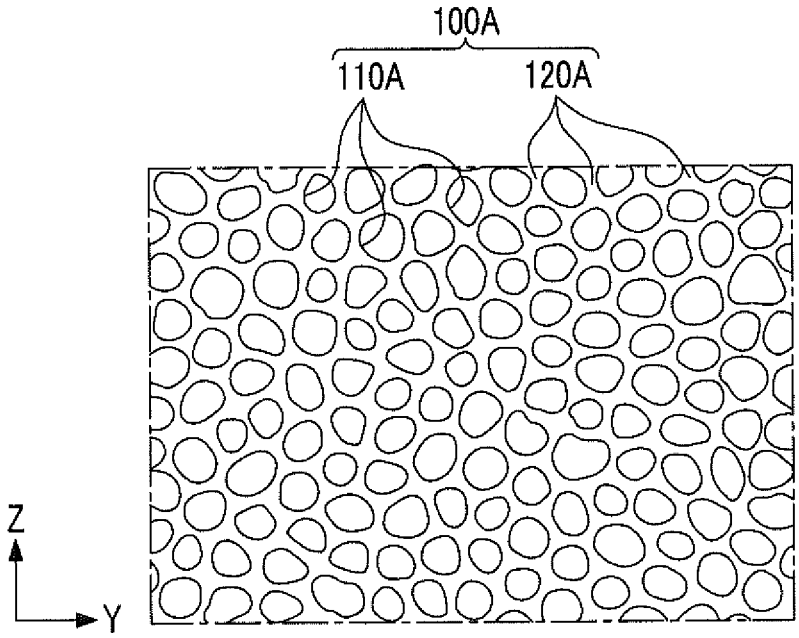
FIG. 7 is a view showing a concave-convex pattern of a W (white)-supply roll of a second exemplary embodiment. Further.
Figure 8:
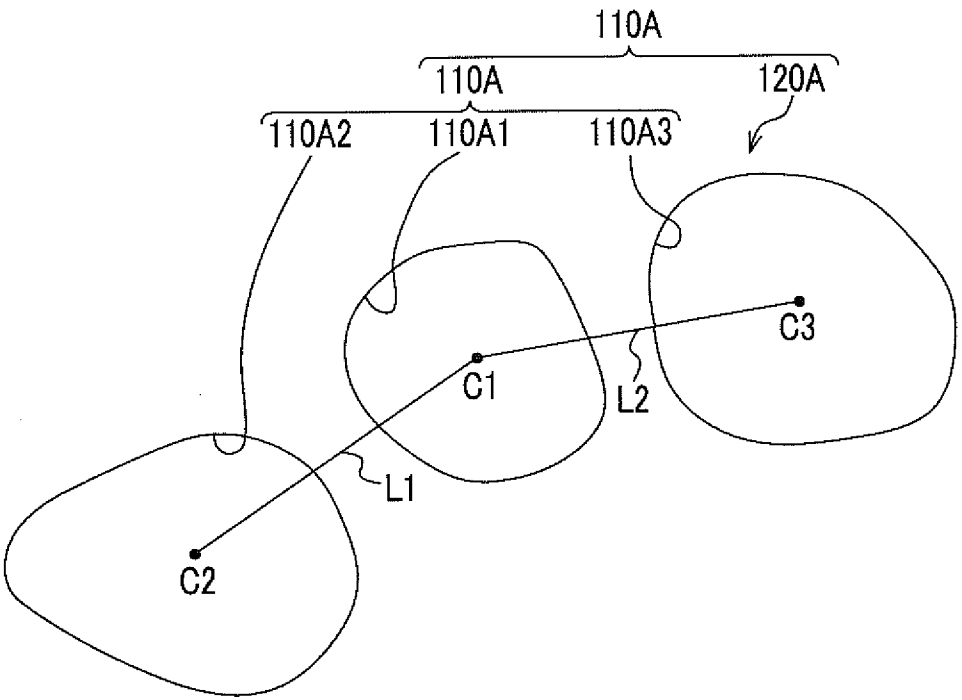
FIG. 8 is a view showing a random concave-convex pattern.

The outer peripheral surface of a supply roll 74W1 of an image forming unit 60W1 of the image forming apparatus 10 according to the second exemplary embodiment includes a random concave-convex pattern 100A shown in FIG. 7. Further, the outer peripheral surface of a supply roll 74W2 of an image forming unit 60W2 includes a random concave-convex pattern 100A shown in FIG. 7. Here, the concave-convex pattern 100A is an example of each of the first and second concave-convex patterns.

Meanwhile, in the random concave-convex pattern 100A, plural recesses 110A are randomly arranged on the outer peripheral surface of the supply roll 74W1. The random arrangement will be described while focusing on, for example, three recesses (recesses 110A1, 110A2, and 110A3) shown in FIG. 8 among the plural recesses 110A. The centroid (center) of the recess 110A1 is denoted by C1, the centroid (center) of the recess 110A2 is denoted by C2, and the centroid (center) of the recess 110A3 is denoted by C3. Furthermore, a line segment connecting C1 with C2 (center distance) is denoted by a center distance L1, and a line segment connecting C1 with C3 (center distance) is denoted by a center distance L2. Moreover, the random arrangement means an arrangement relationship in which the center distance L1 between the recess 110A1 and the recess 110A2 adjacent to the recess 110A1 on one side is different from the center distance L2 between the recess 110A1 and the recess 110A3 adjacent to the recess 110A1 on the other side.

The image forming apparatus 10 according to the second exemplary embodiment has the same structure as the image forming apparatus 10 according to the first exemplary embodiment except for the above-mentioned respect. Meanwhile, it has been described above that each of the outer peripheral surfaces of the supply rolls 74W1 and 74W2 includes the random concave-convex pattern 100A shown in FIG. 7. This does not mean that the same random concave-convex pattern is formed on both the supply rolls 74W1 and 74W2, but means that plural recesses 110A randomly arranged are formed on both the supply rolls 74W1 and 74W2. That is, different concave-convex patterns are formed on the outer peripheral surfaces of the supply rolls 74W1 and 74W2.

In the image forming apparatus 10 according to this exemplary embodiment, pale spots caused by the concave-convex pattern 100A are not easily formed on the superimposed white toner images when the image shown in FIGS. 3A and 3B is formed on the transparent medium P2. Meanwhile, the contrast ratio of the superimposed white toner images, which are formed by the image forming apparatus 10 according to this exemplary embodiment, is 46%.

The operation of this exemplary embodiment is the same as the operation of the first exemplary embodiment.

Third Exemplary Embodiment

Next, an image forming apparatus 10 according to a third exemplary embodiment will be described with reference to FIGS. 9A and 9B. Meanwhile, when members and the like used in the image forming apparatuses 10 according to the first and second exemplary embodiments are used in the third exemplary embodiment, the third exemplary embodiment will be described using the reference numerals of the members and the like without change.

Figure 9A:
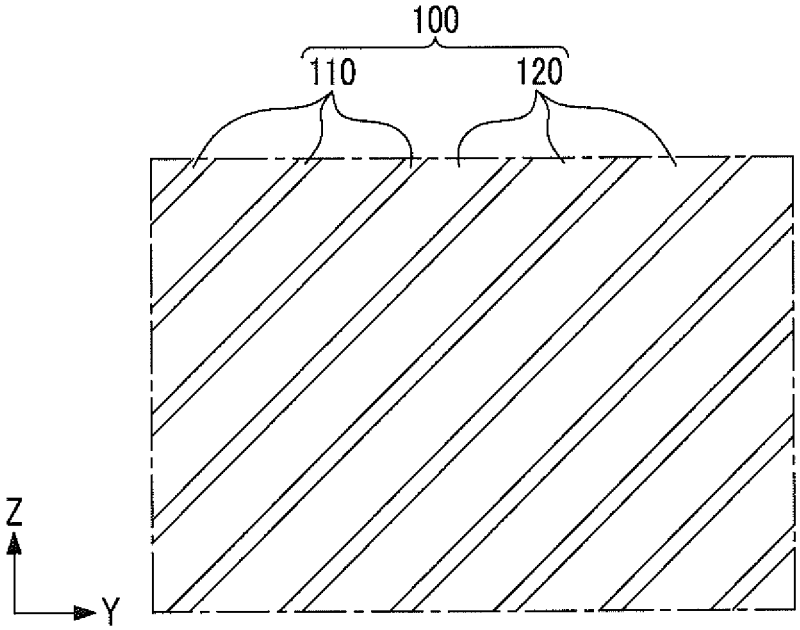
FIGS. 9A and 9B are views showing a concave-convex pattern of a W (white)-supply roll of a third exemplary embodiment, and are views showing a concave-convex pattern formed on the portion surrounded by the two-dot chain line of FIG. 5.
Figure 9B:
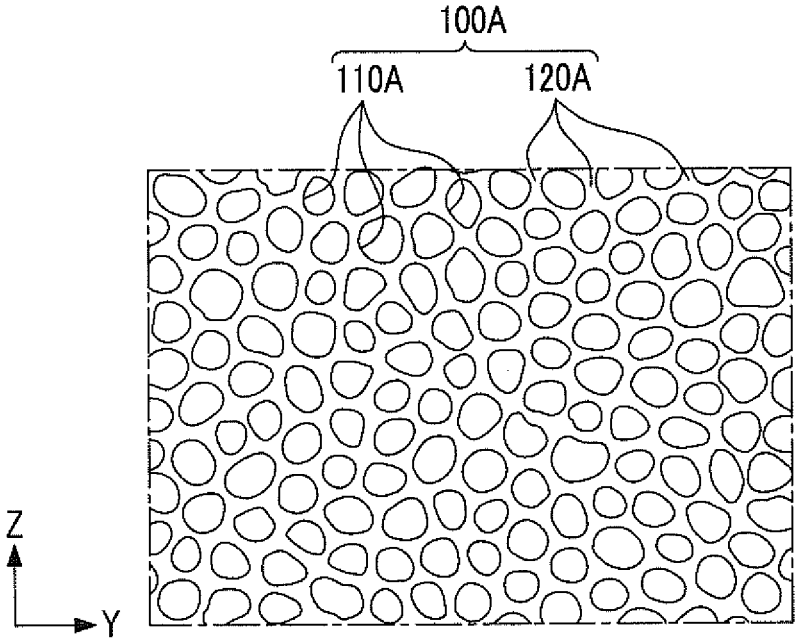

The outer peripheral surface of a supply roll 74W1 of an image forming unit 60W1 of the image forming apparatus 10 according to the third exemplary embodiment includes a concave-convex pattern 100 shown in FIG. 9A, that is, the concave-convex pattern 100 of the supply roll 74W1 of the first exemplary embodiment. Further, the outer peripheral surface of a supply roll 74W2 of an image forming unit 60W2 includes a random concave-convex pattern 100A shown in FIG. 9B, that is, the random concave-convex pattern 100A of the supply rolls 74W1 and 74W2 of the second exemplary embodiment. The image forming apparatus 10 according to the third exemplary embodiment has the same structure as the image forming apparatuses 10 according to the first and second exemplary embodiments except for the above-mentioned respect.

In the image forming apparatus according to this exemplary embodiment, pale spots caused by the random concave-convex pattern 100A are not easily formed on the superimposed white toner images when the image shown in FIGS. 3A and 3B is formed on the transparent medium P2. Meanwhile, the contrast ratio of the superimposed white toner images, which are formed by the image forming apparatus 10 according to this exemplary embodiment, is 46%.

The operation of this exemplary embodiment is the same as the operations of the first and second exemplary embodiments except that the amounts of the developers G to be supplied relative to the circumferential speeds of the supply rolls 74W1 and 74W2 may be made to be equal to each other.

Fourth Exemplary Embodiment

Figure 10:
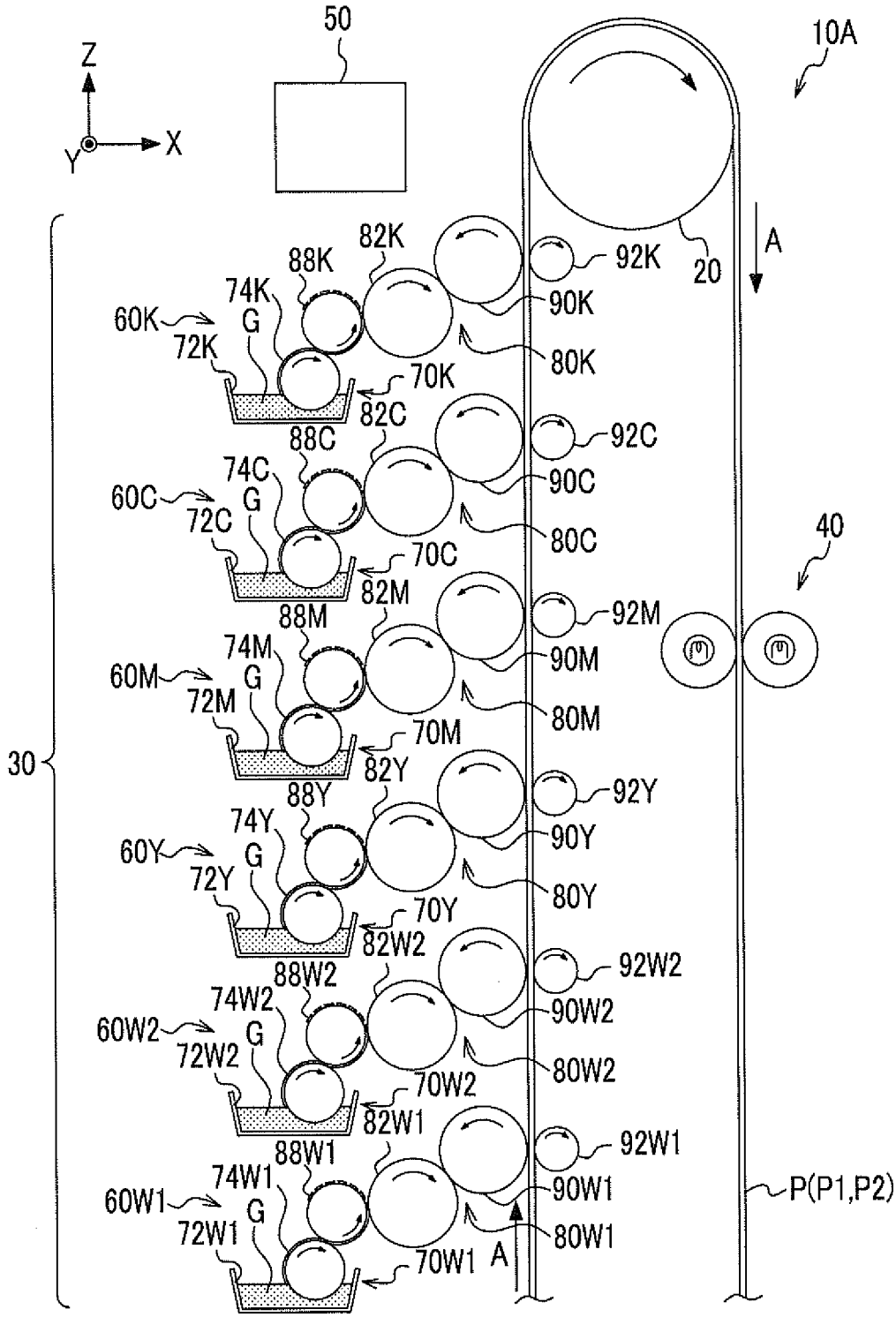
FIG. 10 is a schematic view (front view) of an image forming apparatus according to a fourth exemplary embodiment.
Figure 11B:
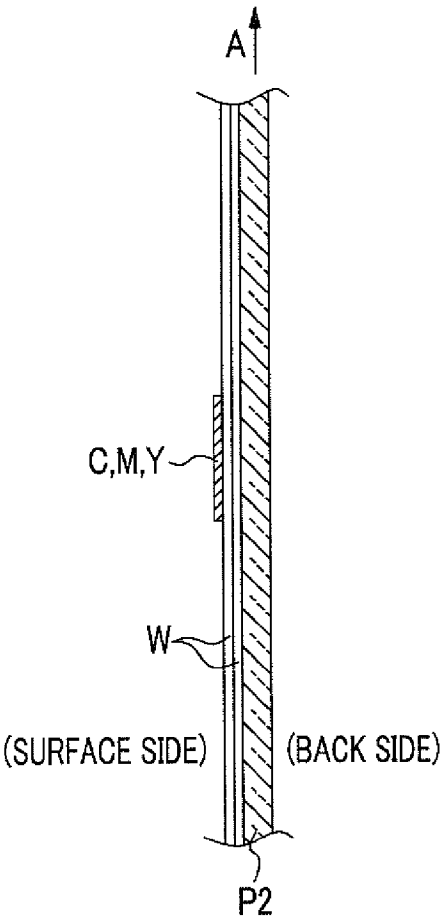
FIGS. 11A and 11B are views showing an image that is formed on a transparent medium by the image forming apparatus according to the fourth exemplary embodiment.
Figure 11A:
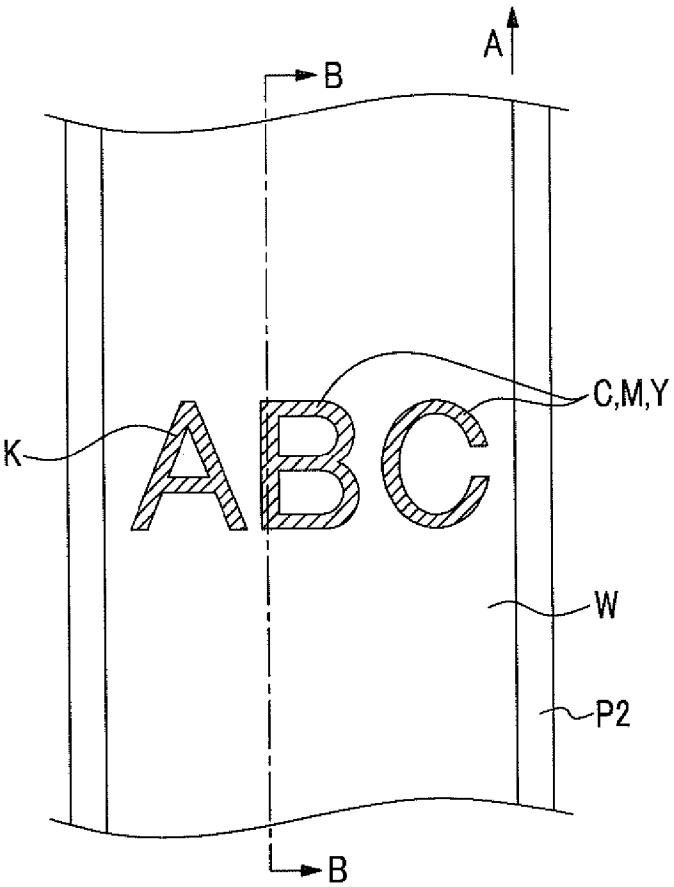

Next, an image forming apparatus 10A according to a fourth exemplary embodiment will be described with reference to FIGS. 10, 11A, and 11B. Meanwhile, when members and the like used in the image forming apparatuses 10 according to the first to third exemplary embodiments are used in the fourth exemplary embodiment, the fourth exemplary embodiment will be described using the reference numerals of the members and the like without change.

The image forming apparatus 10A according to the fourth exemplary embodiment is different from the image forming apparatus 10 according to the first exemplary embodiment in terms of the disposition of the respective image forming units 60 of an image forming section 30. Specifically, as shown in FIG. 10, image forming units 60W1, 60W2, 60Y, 60M, 60C, and 60K are disposed along a transport path of a medium P toward the downstream side from the upstream side in the transport direction of the medium P in this order. The image forming apparatus 10A according to the fourth exemplary embodiment has the same structure as the image forming apparatus 10 according to the first exemplary embodiment except for the above-mentioned respect.

In the image forming apparatus 10A according to the fourth exemplary embodiment, the image forming units 60W1 and 60W2 are disposed on the upstream side of the other image forming units 60Y, 60M, 60C, and 60K in the transport direction of a transparent medium P2. For this reason, the image forming apparatus 10A according to the fourth exemplary embodiment may form an image shown in FIGS. 11A and 11B by using, for example, a transparent medium P2. That is a printed matter, which is completed by an image forming process of this exemplary embodiment, is visually recognized from the front side of the transparent medium P2 (the surface of the transparent medium on which a toner image is formed).

Here, a transfer unit 80W1 of the image forming unit 60W1 is an example of a first transfer unit. A toner image, which is transferred to the medium P by the transfer unit 80W1, is an example of a first image. A transfer unit 80W2 of the image forming unit 60W2 is an example of a second transfer unit. A toner image, which is transferred to the medium P by the transfer unit 80W2, is an example of a second image. One of the transfer units 80Y, 80M, 80C, and 80K of the image forming units 60Y, 60M, 600, and 60K or the combination of two or more thereof is an example of a third transfer unit. A toner image, which is transferred to the medium P by one or more of the transfer units 80Y, 80M, 80C, and 80K, is an example of a third image.

The operation of the fourth exemplary embodiment is the same as the operation of the first exemplary embodiment. Meanwhile, the same supply rolls 74W1 and 74W2 as the supply rolls of the second and third exemplary embodiments may be used in the image forming units 60W1 and 60W2 of the image forming apparatus 10A according to the fourth exemplary embodiment. In this case, the operation of the fourth exemplary embodiment is the same as the operations of the second and third exemplary embodiments.

Fifth Exemplary Embodiment

Figure 12:
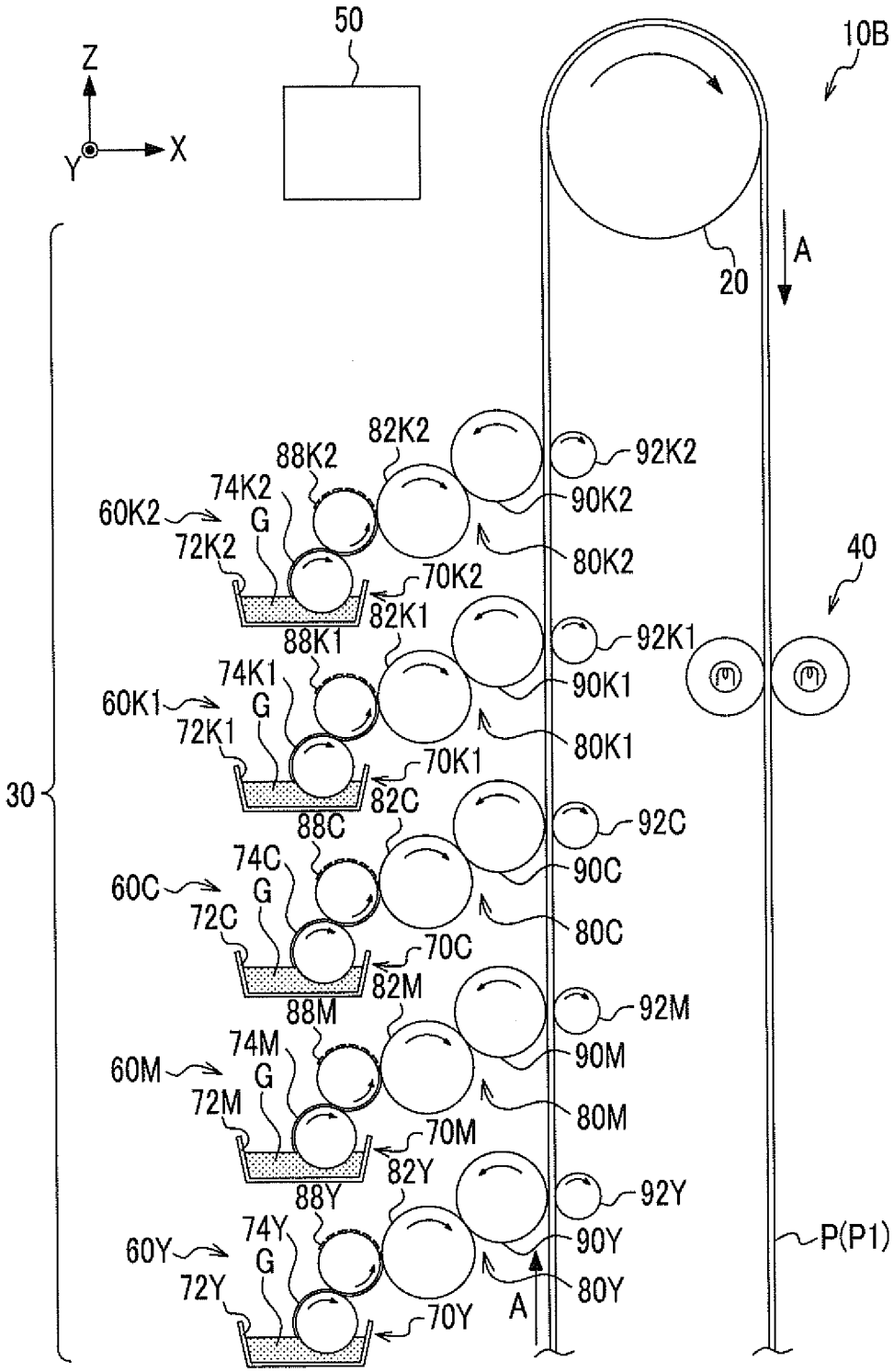
FIG. 12 is a schematic view (front view) of an image forming apparatus according to a fifth exemplary embodiment.
Figure 13B:
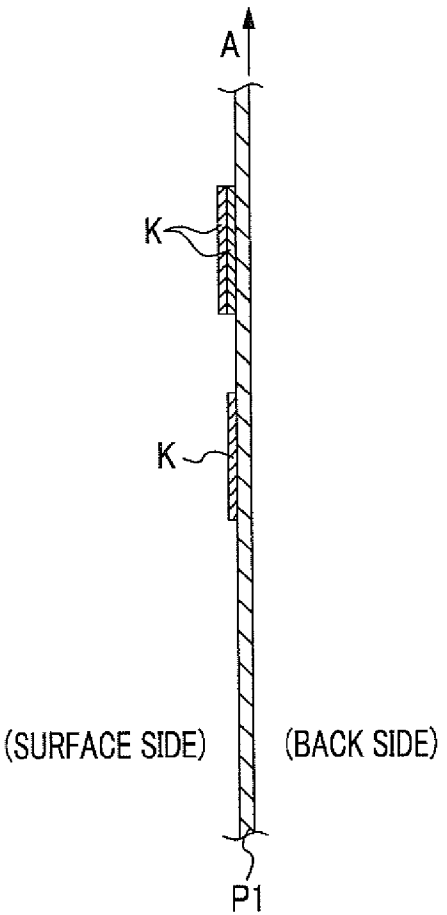
FIGS. 13A and 13B are views showing an image that is formed on a white medium by the image forming apparatus according to the fifth exemplary embodiment.

Next, an image forming apparatus 10B according to a fifth exemplary embodiment will be described with reference to FIGS. 12, 13A, and 13B. Meanwhile, when members and the like used in the image forming apparatuses 10 and 10A according to the first to fourth exemplary embodiments are used in the fifth exemplary embodiment, the fifth exemplary embodiment will be described using the reference numerals of the members and the like without change.

The image forming apparatus 10B according to this exemplary embodiment is different from the image forming apparatus 10 according to the first exemplary embodiment in terms of the structure and disposition of the respective image forming units 60 of an image forming section 30. Specifically, as shown in FIG. 12, image forming units 60Y, 60M, 60C, 60K1, and 60K2 are disposed along a transport path of a medium P toward the downstream side from the upstream side in the transport direction of the medium P in this order. That is, the image forming section 30 of this exemplary embodiment does not include the image forming units 60W1 and 60W2. Meanwhile, the image forming units 60K1 and 60K2 form black toner images. Further, numerals "K1" and "K2" do not mean a difference in color, but mean an order in which the image forming units 60K1 and 60K2 corresponding to a black color are disposed along the transport path of the medium P from the upstream side in the transport direction of the medium P. The image forming apparatus 10B according to this exemplary embodiment has the same structure as the image forming apparatus 10 according to the first exemplary embodiment except for the above-mentioned respect. Here, as shown in FIG. 12, a transfer unit 80K1 of the image forming unit 60K1 is an example of a first transfer unit. A supply roll 74K1 of the image forming unit 60K1 is an example of a first supplier. A toner image, which is transferred to the medium P by the transfer unit 80K1, is an example of a first image. Further, a transfer unit 80K2 of the image forming unit 60K2 is an example of a second transfer unit. A supply roll 74K2 of the image forming unit 60K2 is an example of a second supplier. A toner image, which is transferred to the medium P by the transfer unit 80K2, is an example of a second image. One of the transfer units 80Y, 80M, 80C, and 80K of the image forming units 60Y, 60M, 60C, and 60K or the combination of two or more thereof is an example of a third transfer unit. A toner image, which is transferred to the medium P by one or more of the transfer units 80Y, 80M, 80C, and 80K, is an example of a third image.

In the image forming apparatus 10B according to this exemplary embodiment, an image is formed using, for example, a paper medium P1. Further, as shown in, for example, FIG. 13A, the image forming apparatus 10B may form an image in which characters A, B, and C of the first row are formed of superimposed black toner images, characters A and C of the second row are formed of multi-color toner images of a yellow color, a magenta color, and a cyan color, and a character B of the second row is formed of a black toner image. Here, since the two image forming units 60K1 and 60K2 corresponding to a black color are disposed, the superimposed black toner images may be formed. Meanwhile, a printed matter, which is completed by an image forming process of this exemplary embodiment, is visually recognized from the front side of the paper medium P1 (the surface of the paper medium on which a toner image is formed).

Figure 13A:
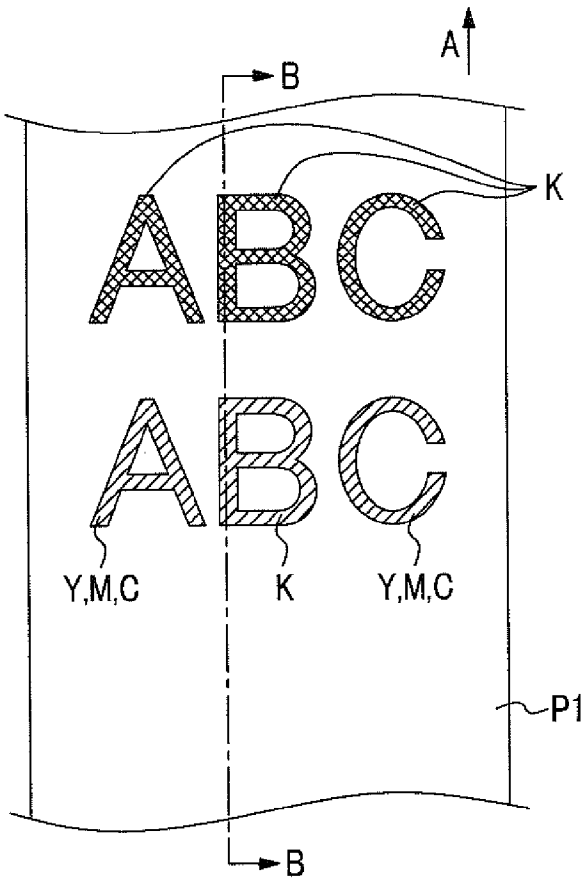

When an image shown in FIG. 13A is formed by the image forming apparatus 10B according to this exemplary embodiment, the contrast ratio of the image of the black characters A, B, and C of the first row is higher than that of the black character B of the second row. That is, the black characters A, B, and C of the first row are visually recognized so as to be darker (more black) than the black character B of the second row.

Here, an image forming apparatus, which is different from the image forming apparatus 10B only in that the image forming apparatus does not include the image forming unit 60K2, (hereinafter, referred to as a comparative apparatus 2) is supposed. The images of the black characters A, B, and C of the first row of FIG. 13A, that is, the superimposed black images, cannot be originally formed in the comparative apparatus 2.

Accordingly, according to the image forming apparatus 10B of this exemplary embodiment, the contrast ratio of the superimposed black images is high in comparison with the comparative apparatus 2. In other words, the image forming apparatus 10B according to this exemplary embodiment may form a superimposed black image that is dark in comparison with the comparative apparatus 2.

Specific exemplary embodiments of the invention have been described above in detail, but the invention is not limited to the above-mentioned exemplary embodiments. The invention may have other exemplary embodiments without departing from the scope of the invention.

Figure 14:
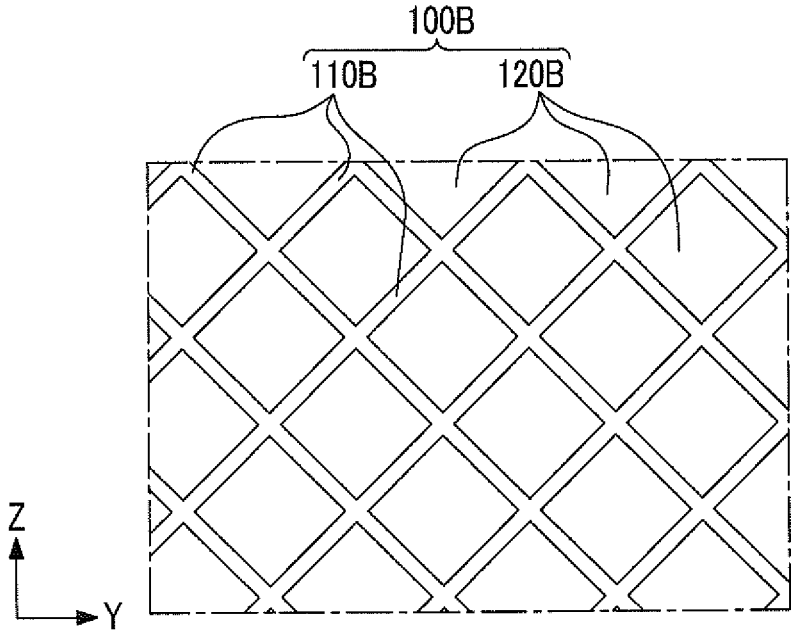
FIG. 14 is a view showing a modification (diamond-shaped concave-convex pattern) of the concave-convex pattern that is formed on the outer peripheral surface of the supply roll.
Figure 15:
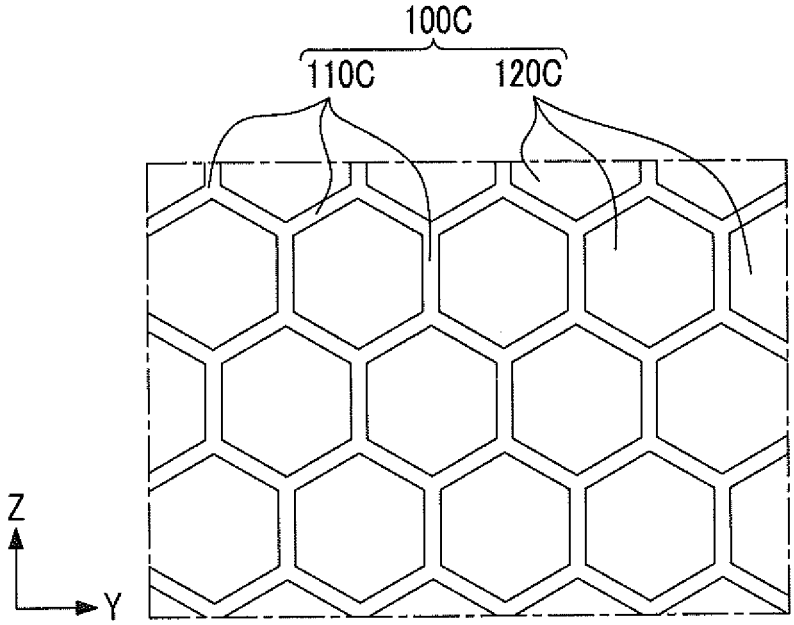
FIG. 15 is a view showing a modification (honeycomb concave-convex pattern) of the concave-convex pattern that is formed on the outer peripheral surface of the supply roll.

For example, the combination of the concave-convex patterns of the outer peripheral surfaces of the supply rolls 74W1 and 74W2 has been exemplified in the first to fourth exemplary embodiments (see FIGS. 6A and 6B, 9A and 9B, and the like). However, if the shapes of the concave-convex patterns of the outer peripheral surfaces of the supply rolls 74W1 and 74W2 are different from each other, the concave-convex patterns of the respective exemplary embodiments may not be combined with each other. For example, the concave-convex pattern 100A of FIG. 7 (a diamond-shaped concave-convex pattern in which 110B denotes recesses and 120B denotes protrusions) and the concave-convex pattern 100E of FIG. 14 may be combined with each other. Further, the concave-convex pattern 100 of FIG. 6A and the concave-convex pattern 100C of FIG. 15 (a honeycomb concave-convex pattern in which 110C denotes recesses and 120C denotes protrusions) may be combined with each other.

Furthermore, the superimposed white toner images have been described as a undercoat in the image forming apparatuses 10B according to the first to fourth exemplary embodiments. However, a white color as the color of the undercoat is exemplary in the first to fourth exemplary embodiments, and a toner image in which other colors except for a white are superimposed may be used as a undercoat. For example, a toner image in which toner colors including glossy colors of, for example, gold, silver, and the like are superimposed may be used as a undercoat.

Moreover, two image forming units 60K1 and 60K2 corresponding to a black color have been described in the image forming apparatus 10B according to the fifth exemplary embodiment. However, two image forming units 60 corresponding to other colors except for a black color may be provided, and superimposed toner images may be formed by the two image forming units 60.

Further, all the image forming apparatuses 10, 10A, and 10B according to the first to fifth exemplary embodiments have been described as electrophotographic type image forming apparatuses. However, as long as liquid containing a toner is supplied to a member, on which a toner image is formed, by a roll, in which a concave-convex pattern is formed on the outer peripheral surface, such as a supply roll 74, the image forming apparatus may not be an electrophotographic type image forming apparatus. For example, the image forming apparatus of the invention may be a so-called flexographic image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated, it is intended that the scope of the invention be defined by the following claims and their equivalents.

What is claimed is:

1. An image forming apparatus comprising:

a first transfer unit that transfers a first image formed by first liquid containing a toner to a medium;

a first supplier that has a first concave-convex pattern formed on an outer peripheral surface thereof, has a first rotation axis, and rotates to supply the first liquid containing the toner to the first transfer unit;

a second transfer unit that transfers a second image formed by second liquid containing a toner of which a color is the same as a color of the toner used in the first liquid to superimpose the second image on the first image transferred to the medium; and a second supplier that has a second concave-convex pattern formed on an outer peripheral surface thereof and having a shape different from a shape of the first concave-convex pattern, has a second rotation axis, and rotates to supply the second liquid containing the toner to the second transfer unit.

2. The image forming apparatus according to claim 1, wherein the first concave-convex pattern includes a first spiral pattern that is inclined with respect to the first rotation axis by a predetermined angle, the second concave-convex pattern includes a second spiral pattern that is inclined with respect to the second rotation axis by the predetermined angle, and the first and second spiral patterns are inclined in directions opposite to each other, and are provided with recesses that have a predetermined depth, a predetermined width, and a predetermined interval.

3. The image forming apparatus according to claim 2, further comprising:

a third transfer unit that is disposed on an upstream side of the first transfer unit in a transport direction of the medium and transfers a third image, which is formed by third liquid containing a toner of which a color is different from the color of the toner, to the medium, wherein the medium is transparent, and the first and second transfer units transfer the first and second images onto the third image.

4. The image forming apparatus according to claim 3, wherein the first and second images are a undercoat image of the third image.

5. The image forming apparatus according to claim 3, wherein the toner in the first liquid is white.

6. The image forming apparatus according to claim 2, further comprising:

a third transfer unit that is disposed on a downstream side of the second transfer unit in a transport direction of the medium and transfers a third image, which is formed by third liquid containing a toner of which a color is different from the color of the toner, to the medium, wherein the third transfer unit transfers the third image onto the first and second images.

7. The image forming apparatus according to claim 6, wherein the first and second images are a undercoat image of the third image.

8. The image forming apparatus according to claim 6, wherein the toner in the first liquid is white.

9. The image forming apparatus according to claim 2, wherein the toner in the first liquid is white.

10. The image forming apparatus according to claim 1, further comprising:

a third transfer unit that is disposed on an upstream side of the first transfer unit in a transport direction of the medium and transfers a third image, which is formed by third liquid containing a toner of which a color is different from the color of the toner, to the medium, wherein the medium is transparent, and the first and second transfer units transfer the first and second images onto the third image.

11. The image forming apparatus according to claim 10, wherein the first and second images are a undercoat image of the third image.

12. The image forming apparatus according to claim 10, wherein the toner in the first liquid is white.

13. The image forming apparatus according to claim 1, further comprising:

a third transfer unit that is disposed on a downstream side of the second transfer unit in a transport direction of the medium and transfers a third image, which is formed by third liquid containing a toner of which a color is different from the color of the toner, to the medium, wherein the third transfer unit transfers the third image onto the first and second images.

14. The image forming apparatus according to claim 13, wherein the first and second images are a undercoat image of the third image.

15. The image forming apparatus according to claim 13, wherein the toner in the first liquid is white.

16. The image forming apparatus according to claim 1, wherein the toner in the first liquid is white.

* * * * *